US011415122B2

(12) United States Patent
Freissler et al.

(10) Patent No.: US 11,415,122 B2
(45) Date of Patent: Aug. 16, 2022

(54) DIAPHRAGM RUPTURE MONITORING

(71) Applicant: ProMinent GmbH, Heidelberg (DE)

(72) Inventors: Bernd Freissler, Dielheim (DE); Alexander Bubb, Plankstadt (DE); Thomas Freudenberger, Ludwigshafen (DE)

(73) Assignee: ProMinent GmbH, Heidelberg (DE)

( * ) Notice: Subject to any disclaimer, the term of this patent is extended or adjusted under 35 U.S.C. 154(b) by 136 days.

(21) Appl. No.: 16/840,602

(22) Filed: Apr. 6, 2020

(65) Prior Publication Data

US 2020/0325886 A1 Oct. 15, 2020

(30) Foreign Application Priority Data

Apr. 9, 2019 (DE) ..... 102019109283.3

(51) Int. Cl.

| | |
|---|---|
| ***F04B 43/00*** | (2006.01) |
| ***F04B 51/00*** | (2006.01) |
| ***F04B 43/02*** | (2006.01) |
| *F04B 49/10* | (2006.01) |

(52) U.S. Cl.

CPC ..... *F04B 43/009* (2013.01); *F04B 43/0054* (2013.01); *F04B 43/0081* (2013.01); *F04B 43/02* (2013.01); *F04B 51/00* (2013.01); *F04B 49/10* (2013.01)

(58) Field of Classification Search

CPC .... F04B 43/02; F04B 43/0054; F04B 43/009; F04B 43/0081; F04B 49/10; F04B 51/00; F16J 3/02

See application file for complete search history.

(56) References Cited

U.S. PATENT DOCUMENTS

| | | | | |
|---|---|---|---|---|
| 4,881,876 | A | 11/1989 | Laziou | |
| 4,971,523 | A | 11/1990 | Wacker et al. | |
| 5,062,770 | A | 11/1991 | Story et al. | |
| 5,074,757 | A * | 12/1991 | Horn | F04B 43/009 417/63 |
| 5,634,391 | A * | 6/1997 | Eady | F16J 3/02 92/99 |
| 6,067,893 | A * | 5/2000 | Drahusz, Jr. | F16J 3/02 92/96 |
| 6,907,816 | B2 | 6/2005 | Bubb et al. | |

(Continued)

FOREIGN PATENT DOCUMENTS

| | | | |
|---|---|---|---|
| DE | 69027857 | T2 | 11/1996 |
| DE | 10233561 | A1 | 2/2004 |
| EP | 2243956 | A2 * | 3/2010 |

*Primary Examiner* — Charles G Freay
(74) *Attorney, Agent, or Firm* — Paul & Paul

(57) ABSTRACT

A diaphragm unit for a diaphragm pump includes a diaphragm core and a multi-layer pump diaphragm connected to the diaphragm core. The pump diaphragm has a fluid-impermeable working layer which comes into contact with a fluid to be delivered, and a fluid-impermeable safety layer. A sealed volume for receiving fluid passing through the working layer is arranged between the working layer and the safety layer. A first clamping region of the diaphragm forms a ring which annularly surrounds the diaphragm core. To detect a rupture of the working diaphragm layer, at least one element of a sensor is provided within the ring formed by the first clamping region for detecting fluid which penetrates into the sealed volume.

19 Claims, 4 Drawing Sheets

(56) References Cited

U.S. PATENT DOCUMENTS

Figure 1:
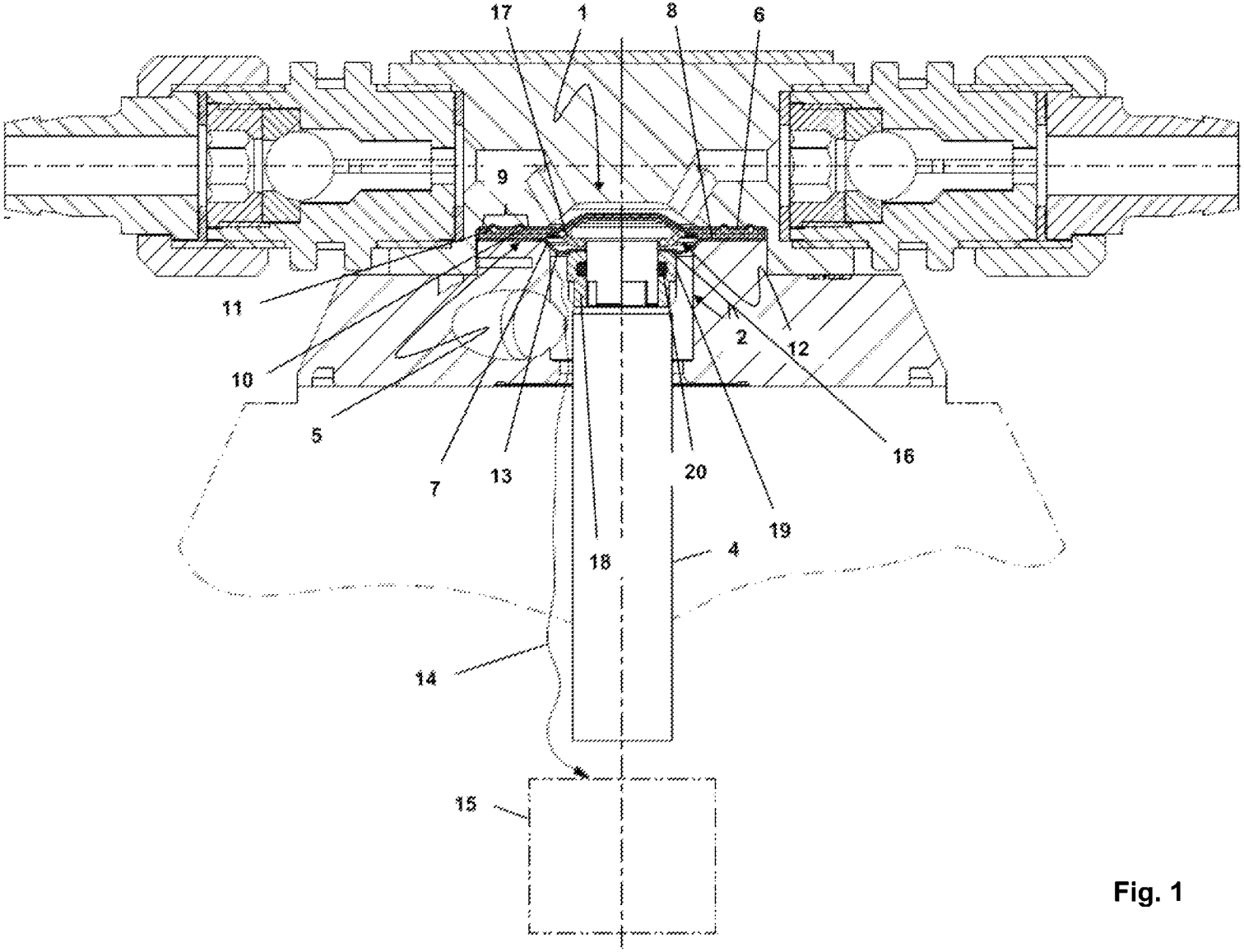

| | | | | |
|---|---|---|---|---|
| 2008/0047882 | A1* | 2/2008 | Freissler | F16L 55/054 210/90 |
| 2021/0270254 | A1* | 9/2021 | Tonelli | F04B 43/009 |

* cited by examiner

DIAPHRAGM RUPTURE MONITORING

CROSS-REFERENCE TO RELATED APPLICATION

This application claims the priority of German Application No. 10 2019 109 283.3, filed on Apr. 9, 2019.

The present invention concerns a diaphragm unit for a diaphragm pump comprising a diaphragm core having a receiving means for a thrust rod of a pump drive, and a multi-layer pump diaphragm connected to the diaphragm core, wherein the pump diaphragm has a fluid-impermeable working diaphragm layer which in operation of the diaphragm pump comes into contact with a fluid to be delivered by the diaphragm pump, and a fluid-impermeable safety diaphragm layer, a sealed volume for receiving a fluid passing through the working diaphragm layer, that is arranged between the working diaphragm layer and the safety diaphragm layer, and a first clamping region with which the pump diaphragm can be received in a receiving means of the diaphragm pump, wherein the first clamping region forms a ring which annularly surrounds the diaphragm core so that provided between the first clamping region and the diaphragm core is an annular region which is elastically deformable in the installed state of the diaphragm unit.

The present invention also concerns a diaphragm pump having such a diaphragm unit.

Diaphragm pumps are used in many cases for the delivery of aggressive, harmful or indeed toxic fluids, that is to say liquids or gases. A rupture in the diaphragm which represents the displacement element in such a diaphragm pump, without further measures, can have the result that the fluid to be delivered issues from the region intended for the flow of the fluid and possibly even from the pump itself.

Those problems have lead to the development of multi-layer redundant pump diaphragms. In such a multi-layer pump diaphragm, disposed behind the working diaphragm layer which in operation of the diaphragm pump comes into contact with the fluid to be delivered by the pump there is a second diaphragm as a safety diaphragm layer which is mechanically coupled to and also moves with the working diaphragm layer. In the event of a rupture in the working diaphragm layer the safety diaphragm layer prevents the fluid to be delivered from escaping from the pump chamber. Further operation of the pump remains possible as the safety diaphragm layer moves like the working diaphragm layer and permits pump delivery to be continued.

The design of the pump diaphragm with at least two layers, in the event of rupture of the working diaphragm layer, ensures redundancy by virtue of the safety diaphragm layer arranged behind it. It will be noted however that after a rupture of the working diaphragm layer, at least the pump diaphragm has to be replaced in order to prevent the safety diaphragm layer from also rupturing with time so that fluid then escapes from the pump chamber through the working diaphragm layer and the safety diaphragm layer. It is therefore necessary to detect the rupture of the working diaphragm layer and the penetration of fluid into the intermediate space between the working diaphragm layer and the safety diaphragm layer.

For that purpose, in configurations of known diaphragms, a sealed volume between the working diaphragm layer and the safety diaphragm layer further fills with the fluid which passes through the ruptured working diaphragm layer. That intermediate space between the working diaphragm layer and the safety diaphragm layer is sealed off relative to the environment.

In order to be able to detect a fluid which passes into the intermediate space between the working diaphragm layer and the safety diaphragm layer the intermediate space is in fluid communication with a measuring chamber, in which case the ingress of fluid into the measuring chamber is detected with suitable sensors.

In the known diaphragm units that measuring chamber with a sensor is disposed in the clamping region of the diaphragm or outside the clamping region and thus in the static region of the diaphragm.

Such an arrangement of the measuring chamber in the static region of the diaphragm is technically complicated and difficult in particular in the case of small diaphragm diameters in combination with low delivery pressures, it requires a large structural space in comparison with the diaphragm diameter which in itself is small, and it cannot be implemented in a viable fashion economically.

In comparison the object of the present invention is to provide a diaphragm unit for a diaphragm pump as well as a diaphragm pump having such a diaphragm unit, which in a simple manner permits detection of a rupture of the working diaphragm layer.

At least one of the above-mentioned objects is attained by a diaphragm unit for a diaphragm pump comprising a diaphragm core having a receiving means for a thrust rod of a pump drive, and a multi-layer pump diaphragm connected to the diaphragm core, wherein the pump diaphragm has a fluid-impermeable working diaphragm layer which in operation of the diaphragm pump comes into contact with a fluid to be delivered by the diaphragm pump, and a fluid-impermeable safety diaphragm layer, a sealed volume for receiving a fluid passing through the working diaphragm layer, that is arranged between the working diaphragm layer and the safety diaphragm layer, and a first clamping region with which the pump diaphragm can be received in a receiving means of the diaphragm pump, wherein the first clamping region forms a ring which annularly surrounds the diaphragm core so that provided between the first clamping region and the diaphragm core is an annular region which is elastically deformable in the installed state of the diaphragm unit. wherein provided within the ring formed by the first clamping region is at least one element of a sensor for detecting a fluid, wherein the sensor is so configured and adapted that in operation of the diaphragm pump it detects ingress of a fluid into the sealed volume of the pump diaphragm.

In accordance with the present application a diaphragm unit is the unit of a diaphragm pump, which is replaced as a structural assembly if the pump diaphragm or a layer thereof is damaged. Besides the pump diaphragm itself the diaphragm unit includes the diaphragm core but generally not the thrust rod connecting the drive motor of the pump to the diaphragm core. Rather the diaphragm core has a receiving means for the thrust rod and can be connected to such a rod.

Embodiments of the invention are conceivable however in which the diaphragm core is fixedly connected to the thrust rod so that, besides the pump diaphragm in the diaphragm unit the diaphragm core also includes the thrust rod. In that case the thrust rod is received in the receiving means of the diaphragm core.

What is decisive for the structure of the pump diaphragm is that it is multi-layer, that is to say has at least two diaphragms, namely a working diaphragm layer and a safety diaphragm layer. The multi-layer structure results in redundancy of the pump diaphragm so that a failure of the working diaphragm layer does not result in fluid escaping from the pump or the pump chamber. In addition provided between the working diaphragm layer and the safety diaphragm layer is a sealed volume into which fluid passing through the working diaphragm layer after a rupture passes in order to be caught but also to be able to detect it.

While in an embodiment of the invention the working diaphragm layer and the safety diaphragm layer are directly connected together to form a sealed intermediate space for receiving the fluid in the event of diaphragm rupture an alternative embodiment provides that disposed between the working diaphragm layer and the safety diaphragm layer is an elastically deformable diaphragm layer, preferably a diaphragm layer having rubber. Such a third diaphragm layer between the working diaphragm layer and the safety diaphragm layer provides the necessary stability for the pump diaphragm.

The pump diaphragm further has a first clamping region with which the diaphragm can be received in a receiving mounting means of the diaphragm pump. The clamping region itself and all portions of the pump diaphragm, that are outside the annular clamping region, are referred to as the static region of the diaphragm as they are substantially not deformed, that is to say they are static, upon a working stroke of the pump diaphragm.

In an embodiment the first clamping region has one or more sealing beads. The at least one sealing bead extends around the diaphragm core in the form of a closed line, in particular in an annular configuration.

As it can be assumed that the most probable location for rupture of the working diaphragm layer is in the region where the loading is high, that is to say between the diaphragm core and the static region, it is desirable if the sealed volume between the working diaphragm layer and the safety diaphragm layer extends at least portion-wise in that region.

In an embodiment of the invention the pump diaphragm is substantially circular, wherein the first clamping region is substantially in the form of a circular ring and the region, which is elastically deformable in the installed state, between the diaphragm core and the clamping region is also in the form of a circular ring. That provides a pump diaphragm which is highly effective in operation.

The underlying idea of the diaphragm unit according to the invention is to detect leakage of the working diaphragm layer that is in contact with the fluid to be delivered, due to the ingress of the fluid that passes through the working diaphragm layer into the sealed volume between the working diaphragm layer and the safety diaphragm layer.

While in all diaphragm units known from the state of the art actual detection of the leaking fluid occurs in a detection chamber in or outside the clamping region of the pump diaphragm the idea of the present invention is to move detection of the fluid leaking into the sealed volume into the dynamic region of the pump diaphragm, that is to say radially within the first clamping region of the pump diaphragm.

In addition in operation of the diaphragm unit in an embodiment there is also a signal output from the element of the sensor, that is within the ring formed by the clamping region, along the thrust rod which can be received in the receiving means of the diaphragm core. In that way there is no need for a signal output from the static region of the pump diaphragm, which saves on construction space and costs.

An element of the sensor in accordance with the present application is for example a lens, an electrode or however also a reflecting wall of a measuring space or volume. Other elements of the sensor, for example a source and a detector for electromagnetic radiation, can be provided outside the diaphragm unit, for example on the drive end of the thrust rod.

In that arrangement the diaphragm unit in an embodiment is so adapted that in operation of the diaphragm unit signal output from the element of the sensor is effected along or in or through the thrust rod which can be received in the corresponding receiving means of the diaphragm core. Signal output from the element of the sensor is effected in an embodiment for example by means of an electric cable, an optical light guide or some other form of guide means for electromagnetic radiation.

For detecting a fluid which has passed through the working diaphragm layer within the ring formed by the clamping region, it is appropriate in an embodiment of the invention if the diaphragm core has a measuring chamber, wherein the diaphragm core and the pump diaphragm are of such a configuration that the measuring chamber and the sealed volume of the pump diaphragm are in fluid communication with each other and wherein the element of the sensor for detecting the fluid is provided in the diaphragm core.

The measuring chamber serves to receive a fluid which upon a rupture of the working diaphragm layer passes into the sealed volume between the working diaphragm layer and the safety diaphragm layer, to detect same, and to signal a rupture of the working diaphragm layer. It is the basic idea of such an embodiment with a measuring chamber, for it to be displaced from the static region of the pump diaphragm into the dynamic region, in comparison with diaphragm units known in the state of the art. In that way the structural space required for the diaphragm unit is considerably reduced in comparison with an arrangement involving the measuring chamber in the static region of the pump diaphragm.

The displacement of actual measurement from the sealed volume between the working diaphragm layer and the safety diaphragm layer in a measuring chamber arranged in the diaphragm core also has a number of advantages. The diaphragm core is typically made from metal or plastic so that a measuring chamber provided in the material of the diaphragm core affords defined measurement conditions.

A displacement of actual measurement from the sealed volume between the working diaphragm layer and the safety diaphragm layer into the measuring chamber of the diaphragm core however requires the sealed volume of the pump diaphragm and the measuring chamber to be in fluid communication with each other.

In an embodiment of the invention that is achieved in that provided between the sealed volume of the pump diaphragm and the measuring chamber of the diaphragm core is a fluid passage which provides the fluid communication between the sealed volume of the pump diaphragm and the measuring chamber of the diaphragm core.

In a further embodiment of the invention that fluid passage has a fluid-permeable structure, preferably a fluid-permeable or capillary fabric, the fluid-permeable structure being arranged between the working diaphragm layer and the safety diaphragm layer.

A fluid-permeable structure of that kind has the advantage that it can be laminated into the pump diaphragm so that simple manufacture of the pump diaphragm including the fluid passage is possible.

In a further embodiment of the invention the safety diaphragm layer has a second clamping region, wherein the safety diaphragm layer is connected in the second clamping region to the diaphragm core, wherein the diaphragm core has a fluid passage of such a configuration that it connects the measuring chamber in the second clamping region to the fluid passage of the pump diaphragm.

In an embodiment of the invention the sensor is an optical sensor which detects a change in the optical property in the measuring chamber. Such an optical property which is detected by the sensor is for example a change in an intensity loss, that electromagnetic radiation experiences when passing through the measuring chamber.

Such a loss in intensity of the electromagnetic radiation which is propagated through the measuring chamber can be caused for example by absorption in the fluid within the measuring chamber.

In an embodiment for example a change in the reflection of a defining wall of the measuring chamber, that occurs by the fluid being arranged in front of the wall, is also suitable for causing a change in the loss of intensity.

In order to cause a marked change in the reflection of the wall portion opposite the receiving means for the thrust rod an embodiment of the invention provides that that wall portion is of a diffusely reflecting nature. In such an embodiment the losses that the electromagnetic radiation experiences in propagation through the measuring chamber would become less if the measuring chamber is filled with fluid or at least the reflecting wall is respectively wetted with fluid.

In an embodiment of the invention the measuring chamber is open towards the receiving means for the thrust rod or is fluid-tightly closed off towards same with a material portion which is transparent for electromagnetic radiation. In that way electromagnetic radiation which is guided by the thrust rod to the diaphragm core can pass into the measuring chamber and can be reflected back from there through the thrust rod.

In a further embodiment of the invention a fluid indicator having an optical property is arranged at a wall portion of the measuring chamber, that is opposite to the receiving means for the thrust rod, wherein the optical property changes when the fluid indicator is brought into contact with a fluid. Such optical properties of a fluid indicator which change upon contact with a fluid are for example absorption, reflection or also colour.

An example of a fluid indicator according to an embodiment of the invention is litmus paper. That changes in colour in dependence on the pH value of the fluid with which it is brought into contact.

Besides sensors which detect an optical property of the measuring chamber itself or a fluid passing into the measuring chamber other sensors are suitable for use in embodiments. An example of such an alternative sensor for detecting a fluid in the measuring chamber is a pressure sensor which preferably has a pressure switch or a strain gauge. In that case in an embodiment at least one element of the pressure sensor is arranged in the diaphragm core, the pressure sensor being so adapted that in operation of the diaphragm unit it detects a fluid pressure in the measuring chamber.

In an alternative embodiment the sensor is a conductivity sensor so arranged and adapted that it detects a change in conductivity in the volume between the working diaphragm layer and the safety diaphragm layer or in the measuring chamber. As the penetration of a fluid into the measuring chamber markedly changes for example the conductivity between two initially mutually insulated electrodes such a sensor is also suitable for detecting the ingress of fluid into the measuring chamber.

Further parameters which can be detected by means of a sensor and which change upon the ingress of a fluid into the volume between the working diaphragm layer and the safety diaphragm layer or into the measuring chamber are conceivable. Changes in parameter can be caused for example by physical-chemical reactions at substances present in the measuring chamber.

At least one of the above-mentioned objects is also attained by a diaphragm pump having a diaphragm unit as has been described in embodiments thereof hereinbefore, wherein the clamping region of the pump diaphragm is received in a mounting receiving means provided for same so that the pump diaphragm seals off a delivery volume of the pump and the core of the diaphragm unit is connected to a thrust rod of a pump drive.

In an embodiment of the invention in that case an electric or optical signal line for signal output from the element of the sensor is passed through the thrust rod to the measuring chamber of the diaphragm core.

In an embodiment of the invention provided in the thrust rod is an optical fibre which connects the measuring chamber at an end of the thrust rod to an arrangement comprising a source for electromagnetic radiation and a detector for the electromagnetic radiation at an opposite end of the thrust rod.

In an embodiment of the invention that the end of the thrust rod that is connected to the diaphragm core is provided with a transparent cover which prevents contamination of or damage to the optical fibre.

In that case in an embodiment of the invention that transparent cover of the thrust rod, when the thrust rod is received in the receiving means of the diaphragm core, forms the sealing of the measuring chamber on one side. In that way upon replacement of the diaphragm unit only a few elements which serve to detect a diaphragm rupture have to be also replaced at the same time.

In an embodiment of the invention the diaphragm pump includes an evaluation device, preferably a microprocessor, so connected to the sensor that it detects a fluid which passes into the measuring chamber upon diaphragm rupture and signals a diaphragm rupture to a user.

Further features, advantages and possible uses of the present invention will now be described by means of embodiments thereof as are shown in the accompanying Figures.

Figure 2:
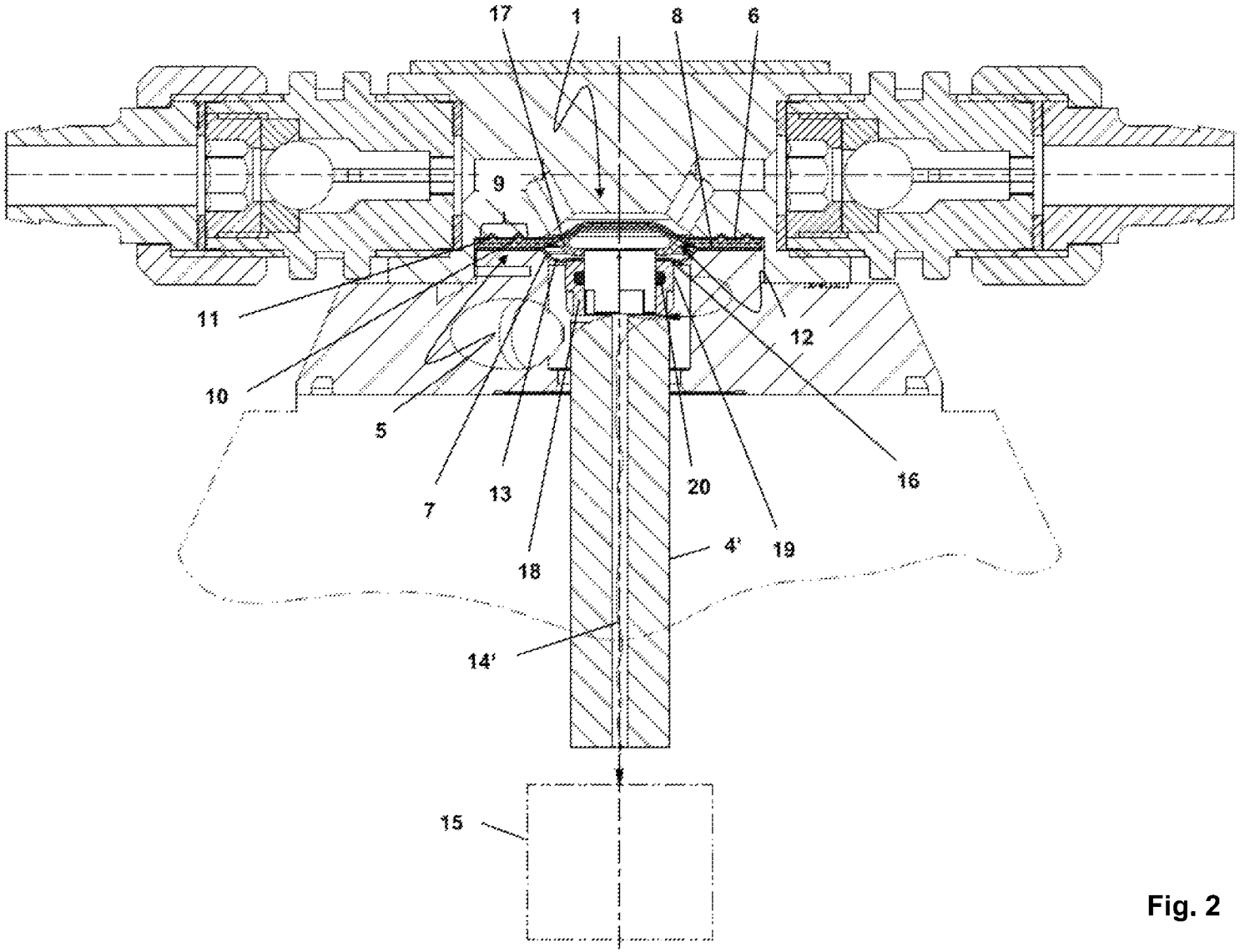
Figure 3:
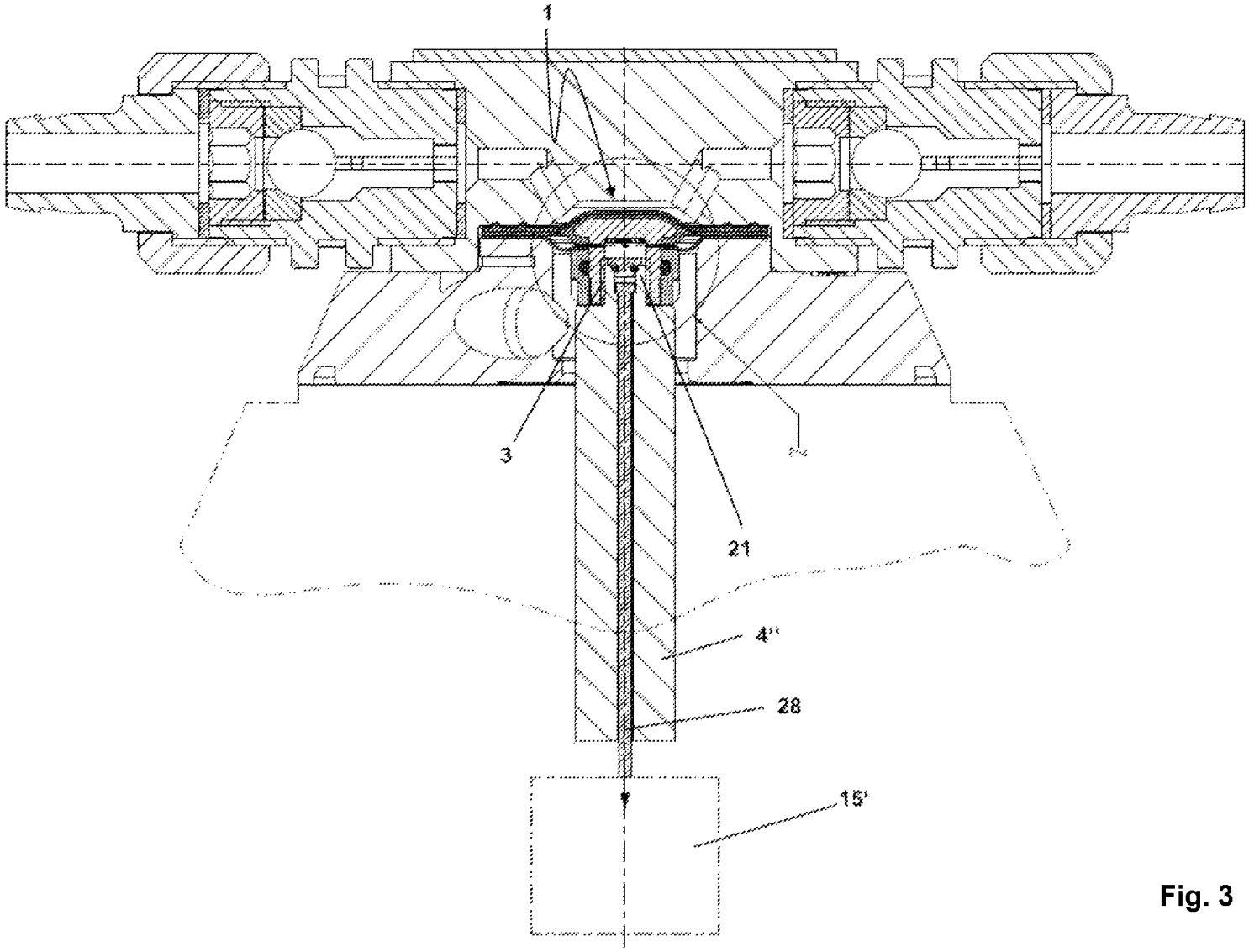
Figure 4:
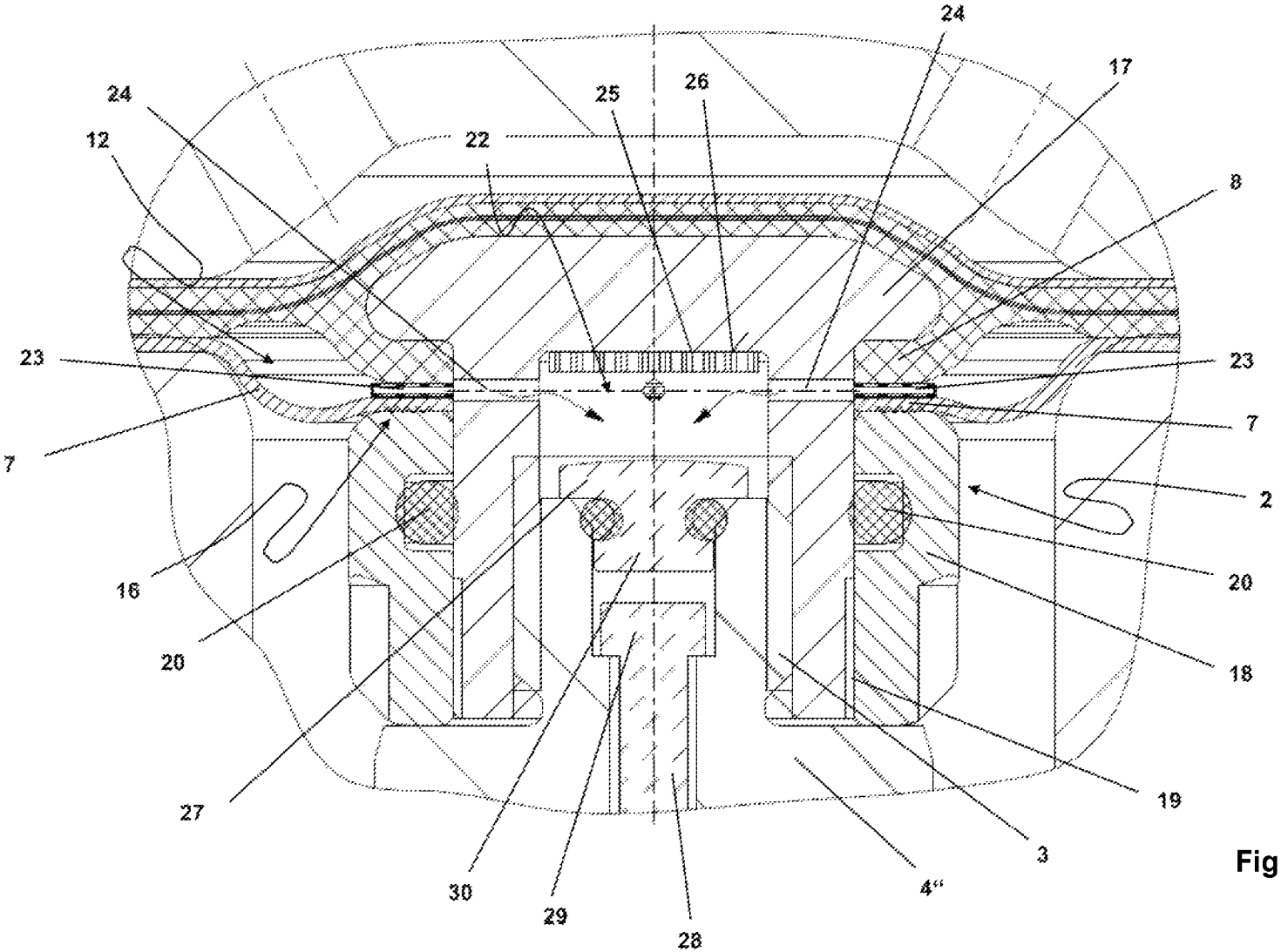

FIG. 1 shows a diagrammatic sectional view through a first embodiment of a diaphragm unit according to the invention, FIG. 2 shows a diagrammatic sectional view through an alternative embodiment of the FIG. 1 diaphragm unit, FIG. 3 shows a broken-away diagrammatic sectional view of a further embodiment of a diaphragm unit according to the invention, and FIG. 4 shows an enlarged diagrammatic sectional view of the measuring chamber in the diaphragm core of the diaphragm unit of FIG. 3.

In the Figures identical elements are denoted by identical references.

FIG. 1 diagrammatically shows the structure of a diaphragm unit 1 installed in a diaphragm pump.

The diaphragm unit 1 has a diaphragm core 2 which is of a two-part configuration in the illustrated embodiment. The diaphragm core 2 has a threaded bore 3 as a receiving means for a thrust rod 4. In the installed state of the diaphragm unit 1 the diaphragm core 2 is connected to the drive of the diaphragm pump by way of the thrust rod 4. In accordance with the present application the thrust rod 4 is not a constituent part of the diaphragm unit so that, in the event of diaphragm rupture or other failure of the diaphragm unit, only the diaphragm unit 1 can be replaced, without the thrust rod 4.

What is essential for the diaphragm unit is further the multi-layer pump diaphragm 5 connected to the diaphragm core 2.

In the embodiments of FIGS. 1 to 3 the pump diaphragm 5 is respectively made up of three layers. A fluid-impermeable working diaphragm layer 6 of PTFE comes into contact with a fluid to be delivered by the diaphragm pump, during operation of the diaphragm unit, and hermetically seals off the pump chamber of the pump. In order to prevent fluid from escaping from the pump chamber in the event of a rupture of the working diaphragm layer 6 the pump diaphragm 5 has a safety diaphragm layer 7 of PTFE. A third diaphragm layer 8 of rubber is arranged between the working diaphragm layer 6 and the safety diaphragm layer 7. That rubber diaphragm layer 8 serves for stabilisation of the pump diaphragm 5 and also provides the required return forces for the pump diaphragm 5.

So that the diaphragm unit 1 can be received in the pump the pump diaphragm 5 has a first clamping region 9 with which the pump diaphragm 5 can be clamped in a corresponding receiving means of the diaphragm pump. The first clamping region 9 of the pump diaphragm 5 has two sealing beads 10, 11. The clamping region 9 of the pump diaphragm and thus the sealing beads 10, 11 surround the substantially cylindrical diaphragm core 2 in an annular configuration, that is to say concentrically.

As in the installed state of the diaphragm unit 1 the first clamping region 9 is fixed in the housing of the pump by clamping thereof it does not also move upon a movement of the core 2. The first clamping region 9 and possibly all portions of the pump diaphragm 5, that are radially outside the clamping region 9 are therefore referred to as the static region of the pump diaphragm 5. In comparison all portions of the pump diaphragm 5, that lie inside the ring formed by the clamping region 9, form the so-called dynamic region of the pump diaphragm 5. In operation of the diaphragm unit that dynamic region moves driven by the drive unit of the diaphragm pump, by means of the thrust rod 4.

If the diaphragm unit 1 of FIG. 1 is considered it will be clear that, by virtue of the connection of the pump diaphragm 5 to the diaphragm core 2, the region of the pump diaphragm 5 between the clamping region 9 and the diaphragm core 2 is subjected to the greatest loading during pumping. It is to be assumed that the pump diaphragm 5 exhibits wear phenomena in that region firstly, if at all. Such wear generally results in rupture of the working diaphragm layer 6 and the rubber diaphragm layer 8 so that fluid issues from the pump chamber through the working diaphragm layer 6 and the rubber diaphragm layer 8. Such fluid which passes through a rupture in the working diaphragm layer 6 and the rubber diaphragm layer 8 is prevented from escaping from the pump by the safety diaphragm layer 7 which forms a redundancy in relation to the working diaphragm layer 6.

In the case of a rupture of the working diaphragm layer 6 and the rubber diaphragm layer 8 however it is not only a question of preventing the fluid from issuing from the pump but also detecting the diaphragm rupture so that the diaphragm unit 1 can be replaced before failure of the safety diaphragm layer 7 also occurs.

To detect a diaphragm rupture of the first two layers 6, 8 of the pump diaphragm 5 the safety diaphragm layer 7 is fixedly connected to the two outer layers 6, 8 only in the clamping region 9. In the dynamic region of the pump diaphragm 5 the safety diaphragm layer 7 is spaced from the rubber diaphragm layer 8 and here forms a sealed volume 12. Fluid which passes through the working diaphragm layer 6 and the rubber diaphragm layer 8 collects in that volume 12. It is now a matter of detecting the fluid which has accumulated in that volume 12 between the working diaphragm layer 6 and the safety diaphragm layer 7 and signalling diaphragm rupture to a user of the diaphragm pump.

The structure of the diaphragm unit 1 which has been described hitherto with reference to FIG. 1 is substantially identical in all embodiments illustrated here as shown in FIGS. 1 to 4.

According to the invention detection of a fluid which has passed into the volume 12 is effected in all embodiments at least with an element of the sensor radially within the ring formed by the outer clamping region 9. In contrast thereto detection of fluid in the volume 12 or in the intermediate space between the working diaphragm layer 6 and the safety diaphragm layer 7 is effected in the state of the art radially outside the clamping region 9 of the pump diaphragm 5. In particular according to the invention signal output is effected from the respective sensor elements radially within the ring formed by the clamping region 9, along the thrust rod 4.

In the embodiment of the diaphragm unit 1 in FIG. 1 the sensor element 13 is formed by a pair of electrodes embedded in the safety diaphragm layer 7. The electrodes project into the region of the volume 12 enclosed by the working diaphragm layer 6 and the safety diaphragm layer 7, into said volume 12. The two electrodes 13 are electrically insulated from each other and it is the ingress of fluid into the volume 12 that first permits an electric current flow between the two electrodes 13. A change in resistance linked thereto can be easily detected and indicates a diaphragm rupture of the first two diaphragm layers 6, 8. For that purpose the sensor element 13 is connected by way of a signal line 14 to an evaluation device, here a microprocessor control 15 of the diaphragm pump. The signal line 14 extends along the thrust rod 4. if a change in resistance is detected by the microprocessor control 15 that signals a diaphragm rupture to the user of the pump.

The alternative configuration of FIG. 2 also has a sensor element in the form of two electrodes 13 in the volume 12. In that case however signal output by way of the signal line 14' is not just effected along the thrust rod 4', but through the thrust rod 4', that is to say in the interior thereof.

The loose end 16 of the safety diaphragm layer 7 which is the radially inner end of the safety diaphragm layer 7 forms a second clamping region 16 in accordance with the present application. The safety diaphragm layer 7 is connected to the diaphragm core 2 with that second clamping region 16 which is disposed radially inwardly in comparison with the first clamping region 9. The diaphragm core 2 comprises two portions 17, 18 which are screwed together, wherein the second portion 18 is screwed by means of a thread 19 in the manner of a nut on to a corresponding male thread of the first diaphragm core portion 17. By virtue of the second portion 18 being screwed on to the first portion 17 the safety diaphragm layer 7 and therewith the second clamping portion 16 of the pump diaphragm 5 are clamped between the first diaphragm core portion 17 and the second diaphragm core portion 18. To achieve a complete sealing action an O-ring seal 20 is provided between the first portion 17 and the second portion 18 of the diaphragm core 2.

In the further embodiment of FIG. 3 the sensing region, that is to say the arrangement of a sensor element is displaced out of the region between the first clamping region 9 and the core 2 into the core 2 itself. The sensing region is identified by a circle 21 in FIG. 3. The sensing region 21 is shown on an enlarged scale in FIG. 4 for better understanding of the arrangement.

In order to be able to detect fluid which passes into the volume 12 between the working diaphragm layer 6 and the safety diaphragm layer 7, within the diaphragm core 2 itself, the diaphragm core 2 has a measuring chamber 22 in fluid communication with the volume 12 so that the fluid can pass out of the volume 12 into the measuring chamber 22. In the illustrated embodiment that fluid communication is afforded by a capillary fabric 23 which, together with the second clamping region 16 of the pump diaphragm 5, is clamped in place between the two portions 17, 18 of the diaphragm core 2. That capillary fabric 23 is permeable for the liquid and even develops a suction action for the fluid from the volume 12 in the measuring chamber 22. In the illustrated embodiment the capillary fabric 23 is laminated on to the safety diaphragm layer 7 in the second clamping region 16.

In addition provided between the clamping region 16 and the measuring chamber 22 are bores 24 which extend in the radial direction and through which the fluid passes into the measuring chamber 22, after passing through the capillary fabric 23.

A plurality of elements of a sensor are arranged in the measuring chamber 22. Those elements are on the one hand a strip of litmus paper 25 fixed on a wall portion 26 of the measuring chamber 22. In addition the measuring chamber is covered by means of a collimator lens 27 of plastic material on the side opposite the wall portion 26. The collimator lens 27 provides a sealing action in respect of the measuring chamber 22 towards the thrust rod 4".

The thrust rod 4" has an optical light guide or optical fibre 28. It serves to pass light, that is to say electromagnetic radiation, to the diaphragm core 2 and thus to the measuring chamber 22 and from same back again into the region of the pump drive. The end 29 of the optical fibre 28, that opens in the diaphragm core end of the thrust rod 4", is protected by means of a transparent protective glass 30 of plastic from mechanical effects and dirt. The thrust rod 4" is screwed into the thread 3 provided for same on the diaphragm core 2.

At the drive end of the thrust rod 4" the optical fibre 28 is connected to a source for electromagnetic radiation, here a diode laser, and a detector, in such a way that light generated by the laser is coupled into the optical fibre 28 and passed to the measuring chamber 22. Light which is reflected out of the measuring chamber 22 back into the optical fibre 28 is detected by the detector.

Besides its sealing action for the measuring chamber 22 the collimator lens 27 serves for collimation of electromagnetic radiation issuing from the optical fibre 28 and focusing of radiation reflected at the wall portion 26 back into the optical fibre 28. If fluid issues through a diaphragm rupture in the first two diaphragm layers 6, 8 of the pump diaphragm 5 and is caught in the volume 12 then that fluid passes into the measuring chamber 22 through the capillary fabric 23. There the litmus paper strip 25 applied to the wall 26 is wetted by the fluid. By virtue of the litmus paper strip 25 being brought into contact with the fluid the latter changes in colour. That change in colour also causes a change in intensity of the electromagnetic radiation reflected by the litmus paper strip 25 back into the optical fibre 28. That change in intensity is detected by means of the detector. As the detector is connected to a microprocessor control the signal from the detector can be evaluated and can possibly signal a diaphragm rupture to the user of the pump.

LIST OF REFERENCES

1 diaphragm unit
2 diaphragm core
3 screw thread for receiving the thrust rod 4, 4', 4"
4, 4', 4" thrust rod
5 pump diaphragm
6 working diaphragm layer
7 safety diaphragm layer
8 rubber diaphragm layer
9 first (outer) clamping region
10, 11 sealing beads
12 volume
13 electrodes
14, 14' signal line
15 evaluation device
15' laser, detector and evaluation device
16 second (inner) clamping region
17 first portion of the diaphragm core 2
18 second portion of the diaphragm core 2
19 screw thread between first and second portions 17, 18 of the diaphragm core 2
20 O-ring seal
21 sensing region
22 measuring chamber
23 capillary fabric
24 bores
25 litmus paper
26 wall portion
27 collimator lens
28 optical fibre
29 end of the optical fibre 28
30 protective glass

The invention claimed is:

1. A diaphragm unit (1) for a diaphragm pump comprising a diaphragm core (2) having a first receiving means (3) for a thrust rod (4, 4', 4") of a pump drive, and a multi-layer pump diaphragm (5) connected to the diaphragm core (2), wherein the pump diaphragm (5) has a fluid-impermeable working diaphragm layer (6) which in operation of the diaphragm pump comes into contact with a fluid to be delivered by the diaphragm pump, and a fluid-impermeable safety diaphragm layer (7), a sealed volume (12) for receiving a fluid passing through the working diaphragm layer, that is arranged between the working diaphragm layer (6) and the safety diaphragm layer (7), and a first clamping region (9) with which the pump diaphragm (5) can be received in a second receiving means of the diaphragm pump, wherein the first clamping region (9) forms a ring which annularly surrounds the diaphragm core (2) so that provided between the first clamping region (9) and the diaphragm core (2) is an annular region which annular region is elastically deformable in an installed state of the diaphragm unit (1), wherein at least one element (13, 27, 25) of a sensor for detecting a fluid is provided inside an area encircled by the ring formed by the first clamping region (9), wherein the at least one element of the sensor is so configured and adapted that in operation of the diaphragm pump the at least one element of the sensor contributes to detection of ingress of a fluid into the sealed volume (12) of the pump diaphragm (5).

2. A diaphragm unit (1) according to claim 1 characterised in that the diaphragm core (2) has a measuring chamber (22), wherein the diaphragm core (2) and the pump diaphragm (5) are of such a configuration that the measuring chamber (22) of the diaphragm core (2) and the sealed volume (12) of the pump diaphragm (5) are in fluid communication with each other, and wherein provided in the diaphragm core is the at least one element (27, 25) of the sensor for detecting a fluid.

3. A diaphragm unit (1) according to claim 2 characterised in that provided between the sealed volume (12) of the pump diaphragm (5) and the measuring chamber (22) of the diaphragm core (2) is a fluid passage (23, 24).

4. A diaphragm unit (1) according to claim 3 characterised in that the fluid passage has a fluid-permeable structure, the fluid-permeable structure being arranged between the working diaphragm layer (6) and the safety diaphragm layer (7).

5. A diaphragm unit (1) according to claim 4 characterised in that the safety diaphragm layer (7) has a second clamping region (16), wherein the safety diaphragm layer (7) is connected in the second clamping region (16) to the diaphragm core, wherein the diaphragm core (2) comprises the fluid passage (24) of such a configuration that it connects the measuring chamber (22) in the second clamping region (16) to the fluid passage (24) of the pump diaphragm (5).

6. A diaphragm unit (1) according to claim 1 characterised in that the sensor is an optical sensor which is so adapted that it detects a change in an optical property in the measuring chamber (22).

7. A diaphragm unit (1) according to claim 1 characterised in that the measuring chamber (22) is open towards the first receiving means (3) for the thrust rod (4, 4', 4") or is fluid-tightly closed off towards same with a material portion (27) which is transparent for electromagnetic radiation.

8. A diaphragm unit (1) according to claim 7 characterised in that a wall portion (26) of the measuring chamber (22), that is opposite to the receiving means (3) for the thrust rod (4, 4', 4"), is diffusely reflecting for electromagnetic radiation.

9. A diaphragm unit (1) according to claim 6 characterised in that a fluid indicator having an optical property is arranged at a wall portion (26) of the measuring chamber (22), that is opposite to the first receiving means (3) for the thrust rod (4, 4', 4"), wherein the optical property changes when the fluid indicator (25) is brought into contact with a fluid.

10. A diaphragm unit (1) according to claim 1 characterised in that the sensor is a pressure sensor, wherein an element of the pressure sensor is arranged in the diaphragm core (2) and wherein the pressure sensor is so adapted that in operation of the diaphragm unit (1) it detects a fluid pressure in the measuring chamber (22).

11. A diaphragm unit (1) according to claim 1 characterised in that the sensor is a conductivity sensor which is so arranged and adapted that it detects a change in conductivity in the measuring chamber (22).

12. A diaphragm pump comprising a diaphragm unit (1) according to claim 1, wherein the clamping region (9) of the pump diaphragm (5) is received in a third receiving means provided to receive the clamping region so that the pump diaphragm (5) seals off a delivery volume of the pump and the diaphragm core (2) of the diaphragm unit (1) is connected to a thrust rod (4, 4', 4") of a pump drive.

13. A diaphragm pump according to claim 12 characterised in that an electrical (14, 14') or optical signal line (28) is passed through or along the thrust rod (4, 4', 4") to a measuring chamber (22) of the diaphragm core (2).

14. A diaphragm pump according to claim 13 characterised in that provided in the thrust rod (4, 4', 4") is an optical fibre (28) which connects the measuring chamber (22) at a first end of the thrust rod (4, 4', 4") to an arrangement comprising a source for electromagnetic radiation and a detector for the electromagnetic radiation at an opposite second end of the thrust rod (4, 4', 4").

15. A diaphragm pump according to claim 14 characterised in that the first end of the thrust rod (4, 4', 4") that is connected to the diaphragm core (2) is provided with a transparent cover (30) which prevents contamination of or damage to the optical fibre (28).

16. A diaphragm pump according to claim 12 characterised in that the diaphragm pump has an evaluation device (15) electrically connected to the sensor, wherein the evaluation device (15) is so adapted that in operation of the diaphragm pump the evaluation device detects a diaphragm rupture.

17. A diaphragm unit (1) according to claim 4 characterised in that the fluid-permeable structure is a fluid-permeable or capillary fabric (23).

18. A diaphragm unit (1) according to claim 10 wherein the pressure sensor has a pressure switch or a strain gauge.

19. A diaphragm pump according to claim 16 wherein the evaluation device signals the diaphragm rupture when the evaluation device detects a diaphragm rupture.

* * * * *